US011376180B2

(12) United States Patent
Bolin et al.

(10) Patent No.: US 11,376,180 B2
(45) Date of Patent: Jul. 5, 2022

(54) GATES FOR OVERHEAD LIFTING RAILS

(71) Applicant: Liko Research & Development AB, Lulea (SE)

(72) Inventors: Andreas Bolin, Lulea (SE); Mattias Andersson, Lulea (SE); Calle Pettersson, Lulea (SE); Robin Ohlund, Lulea (SE)

(73) Assignee: LIKO RESEARCH & DEVELOPMENT AB, Lulea (SE)

( * ) Notice: Subject to any disclaimer, the term of this patent is extended or adjusted under 35 U.S.C. 154(b) by 536 days.

(21) Appl. No.: 15/826,810

(22) Filed: Nov. 30, 2017

(65) Prior Publication Data

US 2018/0153754 A1 Jun. 7, 2018

(30) Foreign Application Priority Data

Dec. 1, 2016 (EP) ..... 16201815

(51) Int. Cl.
*A61G 7/10* (2006.01)
*A61H 3/00* (2006.01)
(Continued)

(52) U.S. Cl.
CPC ..... *A61G 7/1042* (2013.01); *A61G 7/1013* (2013.01); *A61G 7/1034* (2013.01);
(Continued)

(58) Field of Classification Search
CPC ..... B65H 75/44; A61H 3/008; B66C 7/14; B66C 7/16; B66C 7/02; B66C 7/12;
(Continued)

(56) References Cited

U.S. PATENT DOCUMENTS 1,640,344 A 8/1927 Bennington
1,841,454 A * 1/1932 Robertson ..... E01B 25/12
104/98
(Continued)

FOREIGN PATENT DOCUMENTS

CH 373881 A 12/1963
DE 19511035 A1 * 10/1996 ..... E01B 25/24
(Continued)

OTHER PUBLICATIONS

Extended European Search Report dated Sep. 26, 2017 for EP Patent Application No. 16201815.4.
(Continued)

*Primary Examiner* — Peter M. Cuomo
*Assistant Examiner* — Morgan J McClure
(74) *Attorney, Agent, or Firm* — Dinsmore & Shohl LLP

(57) ABSTRACT

The present disclosure relates to a gate system for an overhead lifting rail system, comprising: a first gate comprising: a rail portion for supporting a lifting carriage; and a bridging element pivotally coupled adjacent a proximal end to the rail portion; and a second gate comprising: a rail portion for suspending a lifting carriage; and a bridging element support portion. Upon the first gate engaging with the second gate, a distal end of the bridging element of the first gate engages with the bridging element support portion of the second gate to form a bridge between the first gate and the second gate; and the distal end of the bridging element and the bridging element support portion are configured such that the ends of the bridging element are substantially aligned with the respective ends of the rail portions of the first and second gates.

19 Claims, 12 Drawing Sheets

(51) Int. Cl.
*B66C 7/02* (2006.01)
*B66C 7/14* (2006.01)
*B65H 75/44* (2006.01)

(52) U.S. Cl.
CPC ..... *A61H 3/008* (2013.01); *B66C 7/02* (2013.01); *A61G 7/1049* (2013.01); *A61G 7/1063* (2013.01); *B65H 75/44* (2013.01); *B66C 7/14* (2013.01)

(58) Field of Classification Search
CPC .... A61G 7/1042; A61G 7/106; A61G 7/1013; A61G 7/1034; A61G 7/1049; A61G 7/1063; B61B 3/00; E01B 25/26; E01B 2203/10; E01B 2203/125; E01B 2203/122
See application file for complete search history.

(56) References Cited

U.S. PATENT DOCUMENTS 3,995,561 A * 12/1976 Allor, Jr. ..... B61B 10/025 104/172.4
4,453,469 A * 6/1984 Bedford ..... E01B 25/26 104/100
5,101,734 A * 4/1992 Sakai ..... E01B 25/24 104/106
5,490,293 A 2/1996 Nilsson
5,784,965 A * 7/1998 Zaguroli, Jr. ..... E01B 25/26 104/251
6,318,507 B1 * 11/2001 Jin ..... B66B 5/04 187/351
6,523,195 B1 2/2003 Rodier et al.
6,708,622 B2 3/2004 Bergeron
7,748,326 B2 7/2010 Simmons et al.
8,104,731 B2 1/2012 Faucher et al.
8,296,878 B2 * 10/2012 Imhoff ..... A61G 7/1042 188/43
8,458,827 B2 6/2013 Darrow
8,650,675 B2 2/2014 Imhoff
8,850,635 B2 10/2014 Darrow
9,695,555 B2 * 7/2017 Maenpaa ..... E01B 11/44
2003/0140816 A1 * 7/2003 Bergeron ..... A61G 7/1042 104/89
2005/0098059 A1 * 5/2005 Wallner ..... B66C 11/06 104/89
2008/0056815 A1 * 3/2008 Lolk ..... A61G 7/1042 403/345
2008/0189852 A1 * 8/2008 Gramkow ..... A61G 7/1015 5/85.1
2009/0293757 A1 12/2009 Bischofberger
2010/0288155 A1 * 11/2010 Chepurny ..... A61G 7/1042 104/89
2011/0006026 A1 * 1/2011 Lee ..... B66C 11/14 212/330
2012/0110731 A1 * 5/2012 Hand ..... A61G 7/1015 5/87.1
2013/0164078 A1 * 6/2013 Spies ..... F16B 7/00 403/270
2014/0217749 A1 * 8/2014 Chartier ..... E05C 1/06 292/145
2015/0166084 A1 * 6/2015 Brannstrom ..... B61J 1/00 104/102
2017/0137264 A1 * 5/2017 Bogh-Sorensen ... A61G 7/1042
2017/0194181 A1 7/2017 Chen et al.
2018/0229980 A1 * 8/2018 Givens ..... B66C 7/04

FOREIGN PATENT DOCUMENTS

DE 19511035 A1 10/1996
DE 10218555 A1 5/2003
DE 102013004372 A1 9/2013
EP 0924835 A2 6/1999
EP 0940134 B1 7/2004
GB 703061 A 1/1954
GB 711857 A 7/1954
GB 2418195 A 3/2006
GB 2549475 A 10/2017
GB 2549749 A 11/2017
JP 2006076756 A 3/2006
WO 2005084602 A1 9/2005
WO 2013122538 A1 8/2013
WO 2016004953 A1 1/2016

OTHER PUBLICATIONS

European Search Report filed in Application No. 17204710.2-1113; dated Apr. 25, 2018.

* cited by examiner

GATES FOR OVERHEAD LIFTING RAILS

CROSS REFERENCE TO RELATED APPLICATIONS

The present disclosure claims priority to European Patent Application No. 16201815.4 filed 1 Dec. 2016 and entitled "Gates For Overhead Lifting Rails," the entirety of which is incorporated by reference herein.

BACKGROUND

Field

The present disclosure relates to gates and gate systems for overhead lifting rails, and in particular to gates and gate systems for traverse rails for use in healthcare facilities for lifting and moving patients.

Technical Background

Caregivers may need to move patients from one location to another in a care facility. Sometimes, caregivers use lift systems to assist with lifting and/or moving a patient. The lift systems generally comprise overhead rails, both stationary and movable, and lifting carriages. While various lift systems and ancillary components have been developed, there is still room for improvement. In particular, there is a need to provide improved gates to prevent lifting carriages from leaving the rail, for example when so-called traverse rails, which are movable relative to the fixed, primary, rails are moved from a first primary rail to a second primary rail. Traverse rails may also combine with other traverse rails, and the requirement for providing improved gates to prevent lifting carriages from leaving the rail remains. There is also a need to improve the user experience, reduce wear and tear, and reduce the installation complexity.

SUMMARY

According to one aspect of the present disclosure, there is provided a gate for an overhead lifting rail. The gate comprises: a rail portion for suspending a lifting carriage; a locking pin movable between a first position and a second position, wherein in the first position the lifting carriage is blocked from traversing the rail portion, and in the second position the lifting carriage is able to traverse the rail portion; a locking pin magnetic portion coupled to the locking pin; and a gate magnetic portion fixed relative to the rail portion. At least one of the locking pin magnetic portion and the gate magnetic portion is a permanent magnet. Upon the gate engaging with a corresponding second gate also comprising a rail portion, a locking pin, a locking pin magnetic portion and a gate magnetic portion, the locking pin magnetic portion of the gate engages with the gate magnetic portion of the second gate such that, upon the rail portion of the gate being substantially aligned with the rail portion of the second gate, the locking pin is moved from the first position to the second position.

The use of magnets to move the locking pin removes the requirement for physical interaction between the gates. Such an arrangement not only reduces the wear on the gate components, but also increases the installation tolerances between the gates. This is because the components engage via magnetic fields, and so with no particular requirement for physical engagement, wear is reduced and the distance between the gates becomes of lesser importance. In addition, the noise associated with gates engaging with each other is reduced, which can be an important consideration in the healthcare facility environment.

According to a second aspect of the present disclosure, there is provided a gate system for an overhead lifting rail system. The gate system comprises: a first gate, and a second gate, each gate comprising: a rail portion for suspending a lifting carriage; a locking pin movable between a first position and a second position, wherein in the first position the lifting carriage is blocked from traversing the rail portion, and in the second position the lifting carriage is able to traverse the rail portion; a locking pin magnetic portion coupled to the locking pin; and a gate magnetic portion fixed relative to the rail portion. At least one of the locking pin magnetic portion and the gate magnetic portion is a permanent magnet. Upon the first gate engaging with the second gate, the locking pin magnetic portion of the first gate engages with the gate magnetic portion of the second gate, and the locking pin of the second gate engages with the gate magnetic portion of the first gate such that, upon the rail portions being substantially aligned, each locking pin is moved from the first position to the second position.

As discussed above, the use of magnets to move the locking pin removes the requirement for physical interaction between the gates. Such an arrangement not only reduces the wear on the gate components, but also increases the installation tolerances between the gates. This is because the components engage via magnetic fields, and so with no particular requirement for physical engagement, wear is reduced and the distance between the gates becomes of lesser importance. In addition, the noise associated with gates engaging with each other is reduced, which can be an important consideration in the healthcare facility environment.

As used herein the term "overhead lifting rail system" refers to a system of fixed and movable rails, mounted overhead either to the ceiling or between walls. The movable, or traverse rails, enables patient transfers perpendicular to the longitudinal length of the rail, that is to say in the x-y directions. Fixed rails are used where only movement in a single direction is required, for example over a patient bed, in bathrooms, or in corridors of the healthcare facility. The present gate system enables the two types of rail to be engaged to form a continuous rail, thus enabling the lifting carriage to move from the fixed rail to a traverse rail, or vice versa. Other types of rail components are also envisaged, including turntable switches, where fixed rails are coupled together with a rotatable turntable for selecting the desired pathway for the lifting carriage, and side rail switches for selecting between two fixed rails.

As used herein, the terms "vertical", "horizontal", "above", "below", "top", and "bottom", refer to the directions and relative positions of components associated with the gate system when mounted to, and supported by, a ceiling or between two walls.

As will now be appreciated, the gate system of the present disclosure enables the safe coupling of two rail portions of an overhead rail system, where at least one rail portion is movable substantially perpendicular to the longitudinal length of the other.

To enable the first gate and the second gate to engage, the locking pin magnetic portion of the first gate may be provided at a first vertical distance from the rail portion, and the locking pin magnetic portion of the second gate may be provided at a second vertical distance from the rail portion. In this way, as the first gate engages with the second gate, there is no interference, physical or magnetic, between the locking pin magnetic portions. The gate magnetic portion of the first gate is correspondingly provided at the second vertical distance from the rail portion, and the gate magnetic portion of the second gate is correspondingly provided at the first vertical distance from the rail portion.

Each gate magnetic portion may be configured to magnetically attract the respective locking pin magnetic portion, or vice versa in dependence on which magnetic portion is a permanent magnet. Each gate magnetic portion may be provided substantially at a centre line of the respective gate. Various configurations of magnetic portions are envisaged. The gate magnetic portion may be a permanent magnet, the locking pin magnetic portion being formed of a ferromagnetic material. Alternatively, the gate magnetic portion is a permanent magnet, the locking pin magnetic portion being a permanent magnet. In a further alternative, the gate magnetic portion is formed of a ferromagnetic material, the locking pin magnet being a permanent magnet.

Optionally, each locking pin magnetic portion protrudes from the respective gate, and each gate magnetic portion is provided in a recessed channel in the respective gate, the recessed channel extending from a first side to a second side of the gate. The recessed channels may be provided in the vertical opposing faces of the gates. An edge of each recessed channel may comprise a cam profile configured to engage the respective locking pin magnetic portion and move the locking pin from the second position to the first position upon the first gate and the second gate being disengaged. The edge of each recessed channel comprising the cam profile may be the top edge of the channel. The cam profile may be substantially symmetrical about a centre line of the gate. In this way, the gates may be engaged from either transverse direction. The bottom edge of each recessed channel may be planar.

Where the recessed channels comprise a cam profile, each gate magnetic portion may have a shape which conforms to the cam profile. That is to say, the gate magnetic portion is shaped to fit within the recess, and follow the upper, cammed, profile of the recessed. As will be appreciated, the gate magnetic portion therefore forms the cam profile which is followed by the locking pin magnetic portion to move the locking pin from the first position to the second position.

In embodiments of the present disclosure, there is no physical interaction between the locking pin magnetic portion and either the edges of the recess or the gate magnetic portion. In this way, the gate system is less susceptible to misalignment, and has reduced wear on the components.

Each locking pin may be slidably movable from the first position to the second position. In the first position, a distal end of the locking pin may protrude through a hole in the rail portion to block the lifting carriage from traversing the rail portion. In the second position, the distal end of the locking pin may not protrude through the hole in the rail portion.

The locking pin magnetic portion may be displaced from the longitudinal axis of the locking pin in a direction towards an engagement face of the gate. That is to say, in a direction towards the other gate when the gates are engaged. The locking pin magnetic portion may be coupled to, and displaced from, the locking pin by a shaft portion which extends substantially perpendicularly from longitudinal axis of the locking pin. The shaft portion may be coupled to the locking pin by a threaded connection, or by welding, or by any other suitable coupling such as brazing or adhesion.

Each gate may comprise a bearing insert for supporting the locking pin, and enabling the locking pin to slide along its longitudinal axis. Where the locking pin magnetic portion is coupled to the locking pin by a shaft portion, the bearing insert may have a slot for receiving the shaft portion. The bearing insert may be formed of a polymer, such as a phenolic resin, nylon, PTFE, or polyethylene, in particular Ultrahigh-molecular weight polyethylene (UHMWPE). In embodiments, the bearing insert is formed of polyoxymethylene (POM), also known as acetal.

The locking pin may be formed of metal, in particular steel, such as stainless steel.

In embodiments, each gate magnetic portion comprises a first gate magnet, and a second gate magnet, the first gate magnet being configured to magnetically attract the respective locking pin magnetic portion, and the second gate magnet being configured to magnetically repel the locking pin magnetic portion towards the first gate magnet. The first gate magnet and the second gate magnet may be provided substantially on the centre line of the gate. In embodiments, the first gate magnet and the second gate magnet may be permanent magnets. The locking pin magnetic portion may comprise a first locking pin magnet, and a second locking pin magnet. The first locking pin magnet may be configured to be magnetically attracted to the first gate magnet, the second locking pin magnet being configured to be magnetically repelled from the second gate magnet.

In a further alternative, the gate comprises only a second gate magnet, the second gate magnet being configured to magnetically repel the locking pin magnetic portion. In this alternative, the locking pin magnetic portion comprises a permanent magnet configured to magnetically repel the second gate magnet. In this way, the locking pin is moved from the first position to the second position.

Where each of the first gate and the second gate comprises a recessed channel, the first gate magnet may be provided in the top edge of the recessed channel, and the second gate magnet may be provided in the bottom edge of the recessed channel. As described above, the locking pin magnetic portion may be coupled to, and displaced from, the locking pin by a shaft portion which extends substantially perpendicularly from longitudinal axis of the locking pin. The shaft portion may be coupled to the locking pin by a threaded connection, or by welding, or by any other suitable coupling such as brazing or adhesion. In this embodiment, the locking pin magnetic portion, and the first and second gate magnets are configured to attract and repel in a substantially vertical direction. As will now be appreciated, as the first gate is engaged with the second gate the locking pin magnetic portion approaches the second gate magnet, and is repelled from the second gate magnet towards the first gate magnet which attracts the locking pin magnetic portion, thus moving the locking pin from the first position to the second position. In this way, the locking pin magnetic portion moves in free space, for example within the recessed channel where provided, and does not physically engage with the other of the gates until it is repelled by the second gate magnet and is held against the first gate magnet by magnetic attraction.

The first gate may further comprise at least one alignment magnet, and the second gate may comprises at least one corresponding alignment magnet, the alignment magnets being configured to magnetically attract each other. In this way, the gates, and hence rail portions, are held in alignment by the alignment magnets, and therefore the gates will not move apart unless forced to by an operator. When the alignment magnets are engaged with each other, the locking pin magnet and the gate magnet are also aligned.

The magnets may be permanent magnets, and may be rare-earth magnets such as neodymium magnets. Neodymium magnets are an alloy of Neodymium, Iron, and Boron.

The rail portion may be formed of a C-shaped channel arranged such that, when the gate is supported from a ceiling, its open side is at the bottom. In this configuration, the rail portion comprises a through hole, aligned with the locking pin, for enabling the locking pin to move to the first position and block the lifting carriage from traversing the rail portion.

The rail portion may be formed integrally with a main body portion of the gate. A face of the main body portion, opposite the face comprising the gate magnetic portion and locking pin magnetic portion, may comprise one or more recesses configured to receive an overhead lifting rail. The main body portion may comprise one or more recesses for receiving different sized overhead lifting rails. For example the main body portion may comprise one or more recesses for receiving standard overhead rails having a height of 70 mm, or 100 mm, or 140 mm.

The main body of the gate may be formed of metal, in particular aluminium. The main body may be formed by casting.

The gate system may be configured such that the distance between the gate magnetic portion and the locking pin magnetic portion is between about 1 mm, and about 10 mm, or even between about 2 mm and about 5 mm. The system may further include an installation tool for setting the distance between the first gate and the second gate during installation.

Each gate may be configured to be mountable to a ceiling, either directly or via a mounting arm or the like. Mounting arms may be conventionally referred to as "pendants" and form a part of conventional ceiling mounted lifting systems. Alternatively, or in addition, each gate may be suspended directly from a rail, which in turn is mounted to a ceiling, or to a wall.

According to a further aspect of the present disclosure, there is provided a gate system for an overhead lifting rail system. The gate system comprises: a first gate comprising: a rail portion for supporting a lifting carriage; and a bridging element pivotally coupled adjacent a proximal end to the rail portion; and a second gate comprising: a rail portion for suspending a lifting carriage; and a bridging element support portion. Upon the first gate engaging with the second gate, a distal end of the bridging element of the first gate engages with the bridging element support portion of the second gate to form a bridge between the first gate and the second gate. The distal end of the bridging element and the bridging element support portion are configured such that the ends of the bridging element are substantially aligned with the respective ends of the rail portions of the first and second gates.

When operating an overhead rail system problems may arise when transitioning from a traverse rail to a fixed rail because of deflections of the traverse rail under load which cause a vertical misalignment between the traverse rail and the fixed rail. Although conventional systems allow the misalignment to be overcome using additional force, the result is an uncomfortable ride for the patient being lifted, and additional wear on the system components.

The present disclosure mitigates these disadvantages by providing a bridging element having a distal end which engages with the gate of the fixed rail, and pivots at a proximal end to form a bridge between the traverse rail and the fixed rail.

In embodiments, the bridging element is pivotally coupled at a position substantially aligned with a lifting carriage support surface of the rail portion. In this way, the bridging element is pivotal in such a way that ensures the lifting carriage support surface of the bridging element is always substantially aligned with the lifting carriage support surface of the rail portion.

The pivot may be formed of a first shaft and a second shaft, each shaft disposed on opposite sides of the rail portion. Corresponding plain bearings are provided in the first gate configured to receive the first shaft and the second shaft. The first and second shaft portions and plain bearings may be coated. The coating may be formed by galvanization, or by electropolishing.

Each end of the bridging element support portion may comprise a tapered portion. The tapered portions may be configured to enable the bridging element to engage with the support portion when there is a vertical misalignment between the first gate and the second gate.

In embodiments, the bridging element support portion is formed of an edge of a recessed channel extending from a first side to a second side of the gate. Where the bridging element support portion comprises tapered end portions, the tapered portions may be provided on the bottom edge of the recess. The top edge of the recess may also comprise upper tapered end portions.

The tapered portions may be configured such that the distance from the bottom of the gate to the end of the tapered portion proximal to the support portion is between about 3 mm and about 15 mm greater than the distance from the bottom of the gate to the distal end of the tapered portion.

The second end of the bridging element configured to engage with the support portion may comprise a cantilever vertically offset from the bridging element. The cantilever may be L-shaped. The end of the cantilever configured to engage with the support portion may comprise a coating, such as a low friction coating. For example, the low friction coating may be formed of a polymer, such as a phenolic resin, nylon, PTFE, or polyethylene, in particular Ultrahigh-molecular weight polyethylene (UHMWPE). A particularly effective coating may be PTFE. Providing a coating reduces the friction between the bridging element and the bridging element support portion and therefore may reduce noise and wear.

The bridging element, and gate, may be configured such that the distal end of the bridging element is movable between about −3 mm and about 10 mm on pivoting from a position substantially planar with the rail portion. Movement upwards is defined as positive, and movement downwards is considered negative. Therefore, −3 mm is equivalent to the distal end moving 3 mm down, and 10 mm is equivalent to the distal end moving 10 mm up. In embodiments, the bridging element, and gate, are configured such that the distal end of the bridging element is movable between about −3 mm and about 5 mm, or even between about −3 mm and about 5 mm, on pivoting from a position substantially planar with the rail portion. A stop may be provided on the bridging element to prevent further pivotal movement, or alternatively the bridging element may be prevented from further pivotal movement by abutting a portion of the gate.

The features of the gate and gate system of the first and second aspects of the present disclosure may be combined with the further aspect of the present disclosure. As such, the first gate and the second gate of the gate system according to the further aspect of the present disclosure may each further comprise: a locking pin movable between a first position and a second position, wherein in the first position the lifting carriage is blocked from traversing the rail portion, and in the second position the lifting carriage is able to traverse the rail portion; a locking pin magnetic portion coupled to the locking pin; and a gate magnetic portion fixed relative to the rail portion. At least one of the locking pin magnetic portion and the gate magnetic portion is a permanent magnet. Upon the first gate engaging with the second gate the locking pin magnetic portion of the first gate engages with the gate magnetic portion of the second gate, and vice versa, such that, upon the rail portion of the first gate being substantially aligned with the rail portion of the second gate, each locking pin is moved from the first position to the second position.

As will be appreciated, all of the features of one aspect of the embodiments described above may be combined in any suitable combination with the features of the further aspect of the present disclosure.

As used herein, the terms "may" and "optionally" refer to features of the present disclosure which are not essential, but which may be combined with the claimed subject matter to form various embodiments of the disclosure.

Furthermore, any feature in one aspect of the disclosure may be applied to other aspects of the disclosure, in any appropriate combination. In particular, method aspects may be applied to apparatus aspects, and vice versa. Furthermore, any, some and/or all features in one aspect can be applied to any, some and/or all features in any other aspect, in any appropriate combination.

It should also be appreciated that particular combinations of the various features described and defined in any aspects of the disclosure can be implemented and/or supplied and/or used independently.

BRIEF DESCRIPTION OF THE DRAWINGS

The gates and gate systems will be further described, by way of example only, with reference to the accompanying drawings in which:

FIG. 1(*b*) shows another portion of the locking gate system for an overhead lifting rail system of FIG. 1(*a*);

FIG. 3(*b*) is one example of a locking pin for use in the gate system shown in FIGS. 1(*a*) and 1(*b*);

FIG. 3(*c*) is one example of a locking pin for use in the gate system shown in FIGS. 1(*a*) and 1(*b*);

FIG. 3(*d*) is one example of a locking pin for use in the gate system shown in FIGS. 1(*a*) and 1(*b*);

FIG. 4(*b*) shows another portion of the locking gate system for an overhead lifting rail system of FIG. 4(*a*)

FIG. 7(*b*) shows another portion of the bridging gate system for the overhead lifting rail system of FIG. 7(*a*);

FIG. 9(*b*) shows an alternative view of the gate system shown in FIG. 8;

DETAILED DESCRIPTION

The present disclosure relates generally to overhead lifting systems for lifting and moving patients in healthcare facilities. Although it will be appreciated that the system has other uses. Such overhead lifting systems comprise fixed overhead rails, and moving, traverse, rails, and lifting carriages which run along the rails and have lifting and lowering mechanisms. The rails are generally supported by a ceiling or between two walls. The traverse rails are themselves mounted to rails, which generally run perpendicularly to enable the traverse rails to be moved between different fixed rail portions. The present disclosure is concerned with the gates which enable the lifting carriage to pass safely from a fixed rail to a traverse rail.

Figure 1B:
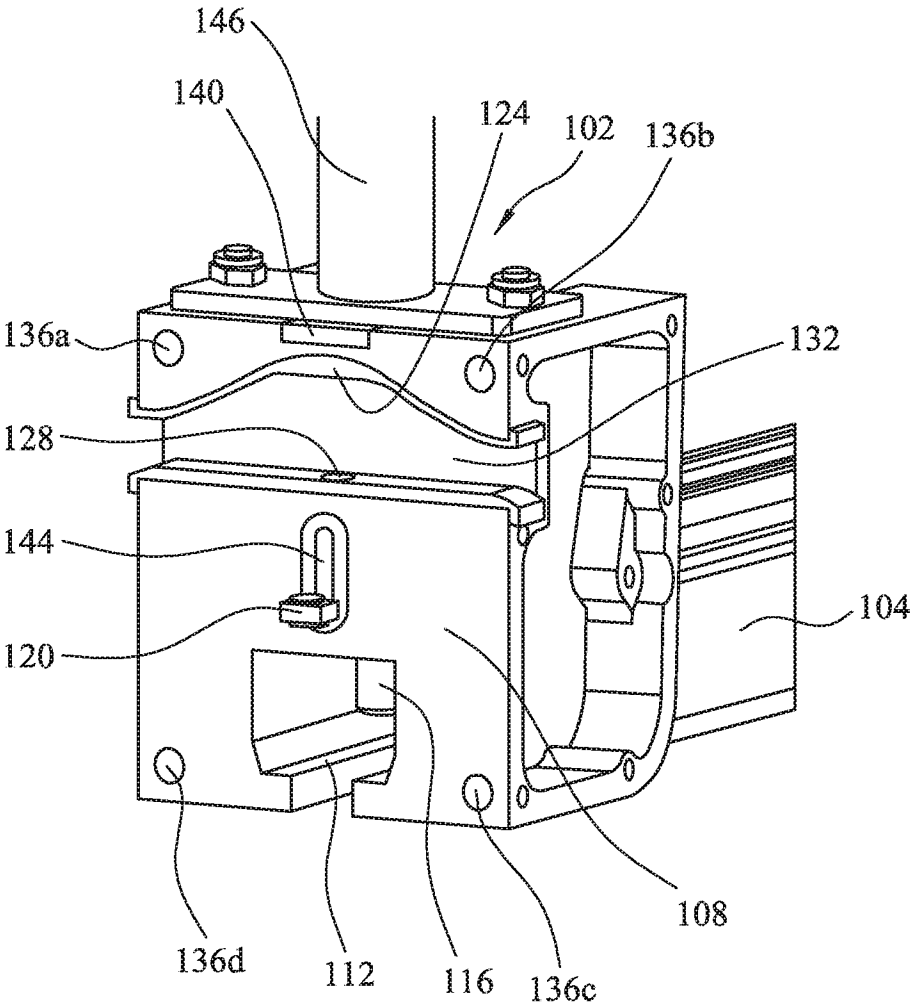
FIG. 1(*a*) shows a locking gate system for an overhead lifting rail system.
Figure 1A:
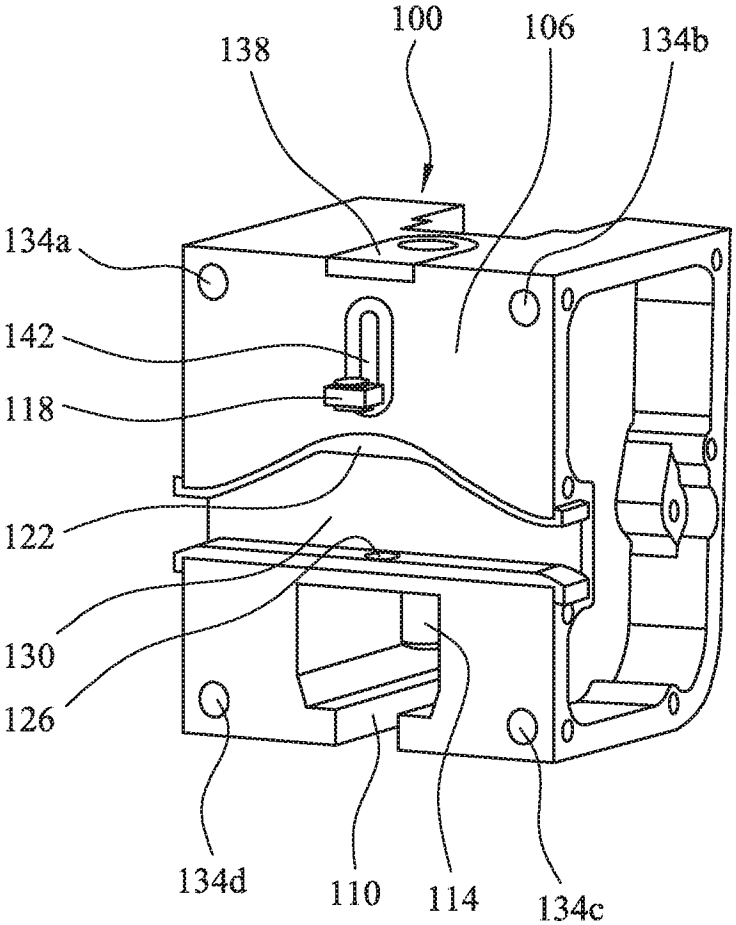

FIGS. 1(*a*) and 1(*b*) show an example of one such gate system, which is a locking gate system, comprising a first gate 100 and a second gate 102. In this example, the gate 100 is coupled to a traverse rail (not shown), and the gate 102 is coupled to a fixed rail 104. For ease of reference, the faces 106 and 108 of the gates which engage with each other are shown facing away from each other, but as will be appreciated, in use, the faces 106 and 108 face each other. The first gate 100 and the second gate 102 each comprise, inter alia, a rail portion 110, 112, a locking pin 114, 116, a locking pin magnet 118, 120, a first gate magnet 122, 124, a second gate magnet 126, 128, and a recessed channel 130, 132. The first gate 100 and second gate 102 each further comprise alignment magnets 134*a*, 134*b*, 134*c*, 134*d*, 136*a*, 136*b*, 136*c*, 136*d* respectively provided at the corners of the engaging faces 106 and 108. The alignment magnets 134 are configured to be magnetically attracted to the alignment magnets 136. That is to say, the north pole of the magnets 134 faces outwards, and the south pole of the magnets 136 faces outwards (or vice versa).

The locking pin magnet 118, 120 is coupled perpendicularly to the respective locking pin 114, 116 by a shaft (not shown). The locking pin 114, 116 is vertically slidable within a bearing 138, 140 to enable the pin to slide from a first position, as shown in FIG. 1, to a second position. As the locking pin 114, 116 slides from the first position to the second position, the locking pin magnet shaft slides within the slot 142, 144.

In the first position, the locking pin 114, 116 blocks the rail portion 110, 112 so that a lifting carriage is blocked from traversing the respective rail portion. In this way, when the rail portion 110 is not aligned with the rail portion 112 the locking pins 114, 116 prevent the lifting carriage from rolling off the end of the rail.

As can be seen, each recessed channel 130 and 132 has an upper edge with a cammed profile. The lower edge of each recessed channel is substantially planar, but is shown having tapered end portions.

The second gate 102 is mounted to a ceiling (not shown) by the mounting support 146. The first gate 100 is mounted to a traverse rail (not shown), which in turn is mounted to the ceiling by further guide rails which enable movement of the traverse rail perpendicularly to the longitudinal length of the rail.

In this example, the main body of each gate 100, 102 is formed of aluminium to reduce the total weight as compared to, for example, steel, and to reduce or eliminate the magnetic interference between the main body and the gate magnet and locking pin magnet. The locking pins 114, 116, and shaft portions for coupling the locking pin magnets to the locking pins are formed of steel. The magnets are formed of an alloy of Neodymium, Iron, and Boron, which are commonly known simply as Neodymium magnets. The bearings 138, 140 are formed of polyoxymethylene (POM).

Figure 2:
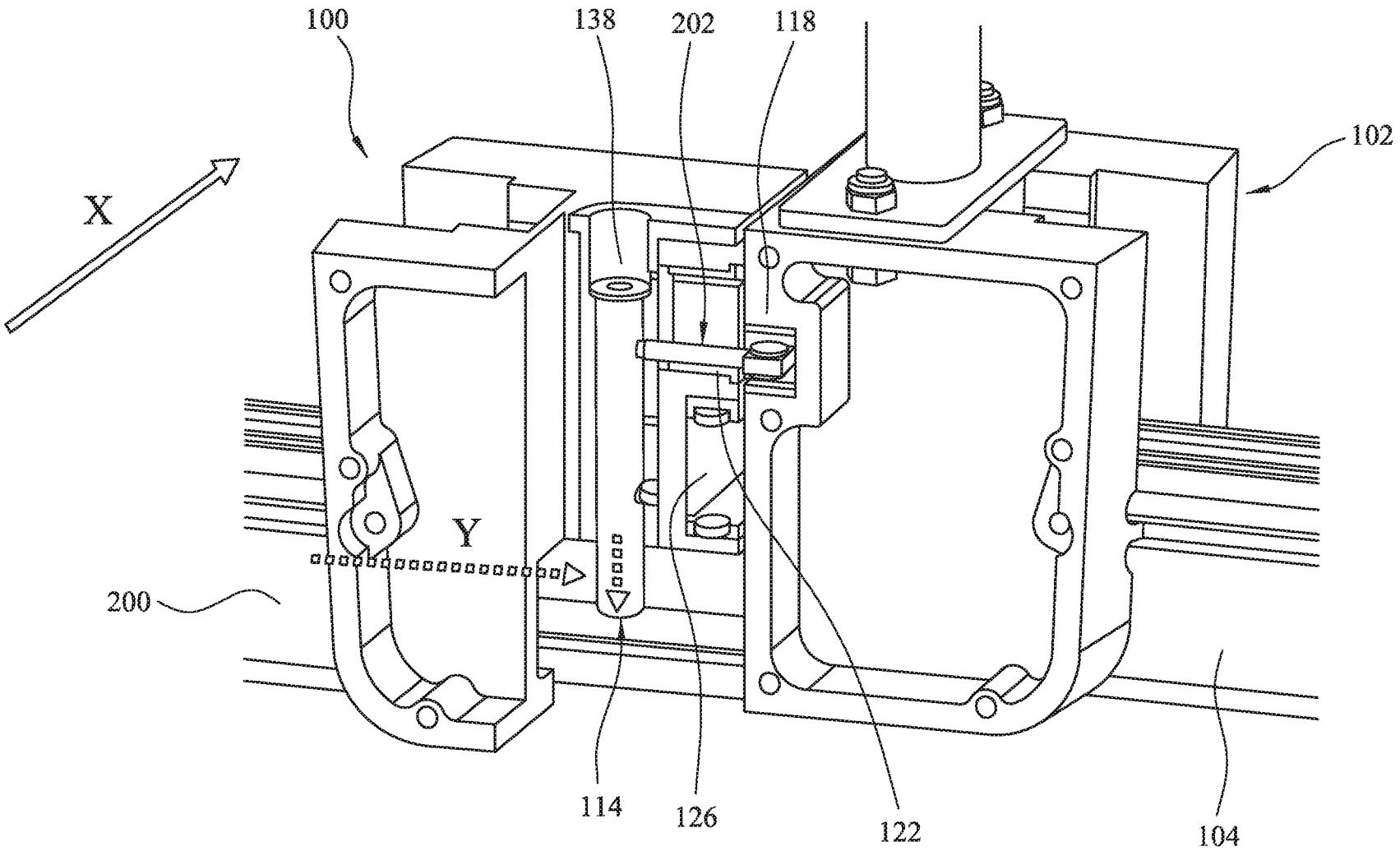
FIG. 2 shows a cut-away view of the gate system shown in FIGS. 1(*a*) and 1(*b*)
Figure 3:
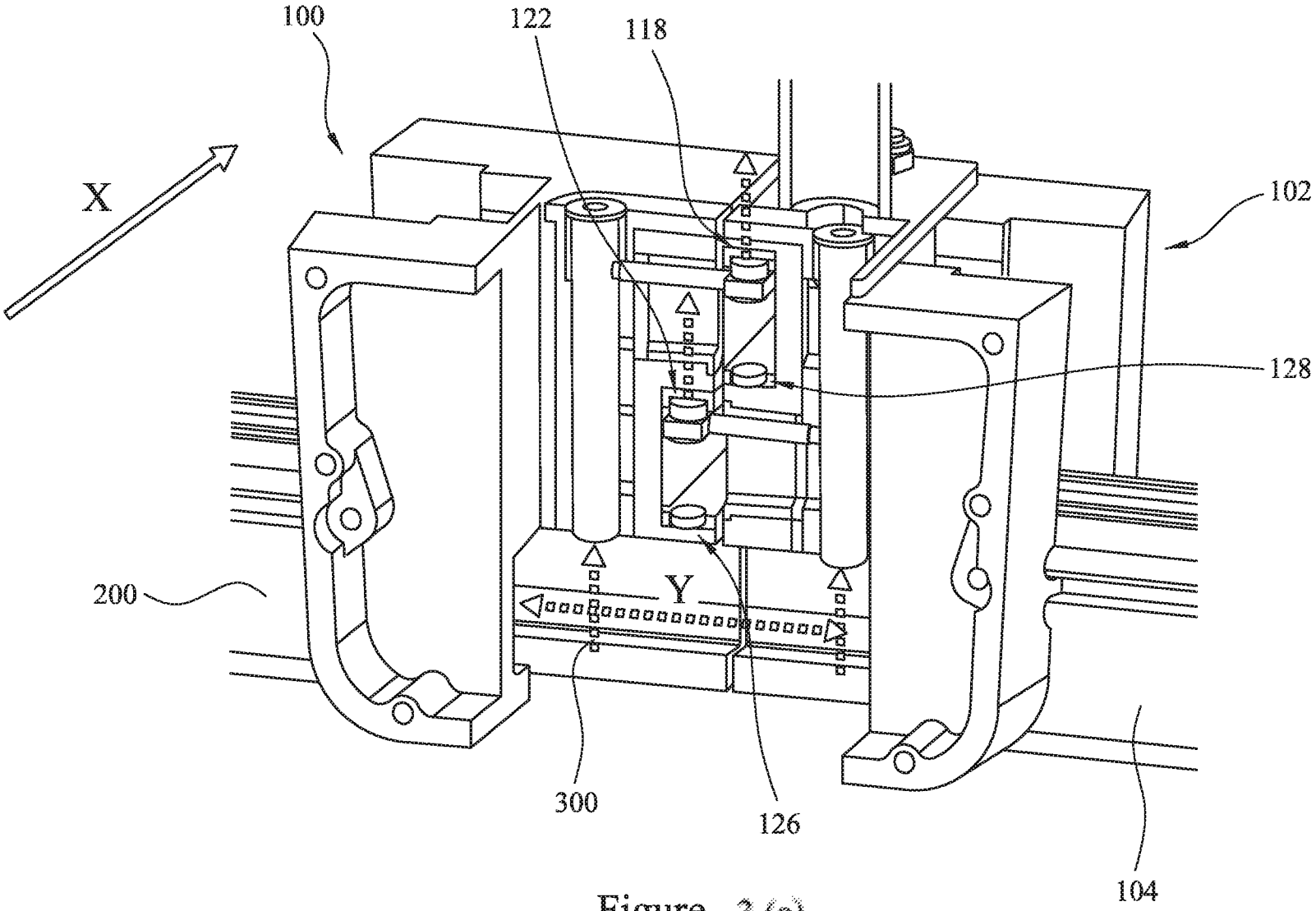
FIG. 3(*a*) shows a further cut-away view of the gate system shown in FIGS. 1(*a*) and 1(*b*)
Figure 3D:
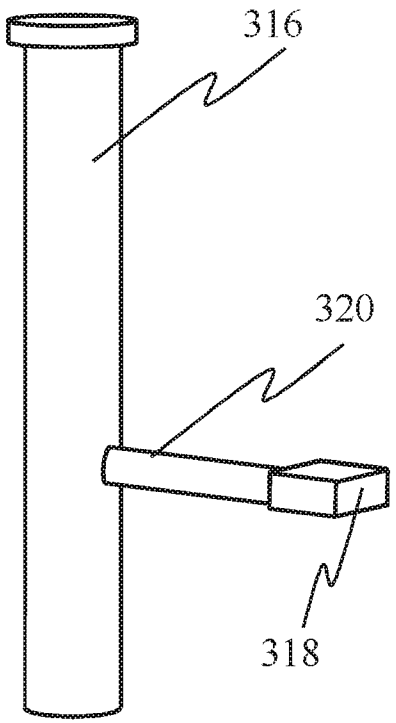
Figure 3C:
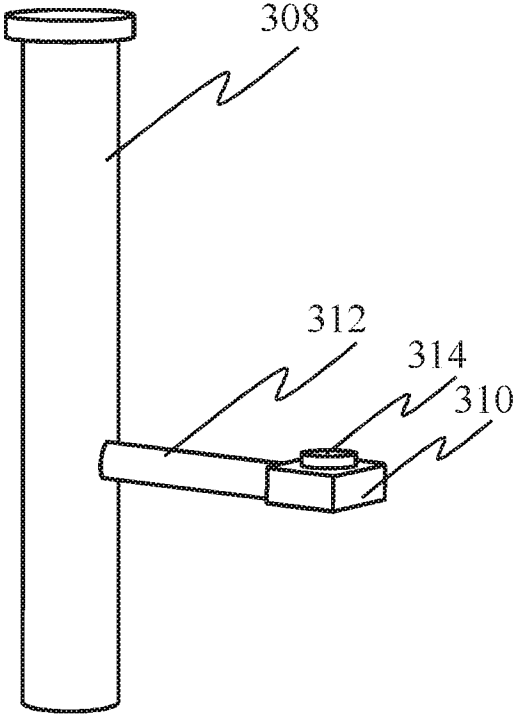
Figure 3B:
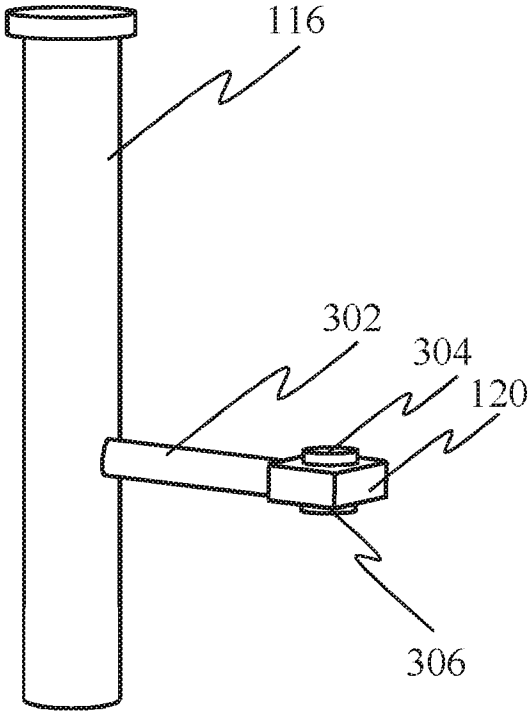

FIGS. 2 and 3 show the gates 100 and 102 in the process of engaging with each other, and the respective locking pins being moved from the first position to the second position. It is noted that throughout the figures, like reference numerals refer to like features.

In FIG. 2, the gate 100, attached to the traverse rail 200 movable in the direction X, is shown at the initial stage of engagement with the gate 102 attached to the fixed rail 104. As can be seen, the locking pin 114 is in the first position, and would prevent a lifting carriage from traversing the rail portion 110 in direction Y. The locking pin magnet 118 is shown at a first end of the recessed channel 132 of gate 102. The first gate magnet 122 and the second gate magnet 126 of the first gate 100 are also shown. As can be seen, the first gate magnet 122 is recessed into the upper edge of the recessed channel to provide a smooth surface. Likewise, the second gate magnet 126 is recessed into the lower edge of the recessed channel. It is noted that the shaft portion 202 is shown which couples the locking pin magnet 118 to the locking pin 114.

Upon the first gate 100 being traversed into alignment with the second gate 102, the second gate magnet 126 of the first gate 100 repels the locking pin magnet 120 of the second gate 102, and the second gate magnet 128 of the second gate 102 repels the locking pin magnet 118 of the first gate 100. The locking pins 114 and 116 are therefore repelled away from the first position towards the second position. In addition, the first gate magnet 122 of the first gate 100 attracts the locking pin magnet 120 of the second gate 102, and the first gate magnet 124 of the second gate 102 attracts the locking pin magnet 118 of the first gate 100. The locking pins 114 and 116 are therefore also attracted towards the second position, and, while the gates 100 and 102 are aligned, the locking pins 114 and 116 are maintained in the second position by the first gate magnets 122 and 124.

In this aligned configuration, the alignment magnets 134 and 136 maintain the gates together until a user, such as a healthcare professional, moves the traverse rail.

With the gates aligned, and the locking pins in the second position, a lifting carriage is free to traverse the rails from the fixed rail to the traverse rail or vice versa in the Y direction. This is because a substantial portion of a lifting carriage of this type runs within the rails, being supported by the support surface of the rails 300, as shown in FIG. 3(*a*).

FIGS. 3(*b*), 3(*c*) and 3(*d*) each show a variant of a locking pin configured for use in a gate system as described with reference to FIGS. 1, 2 and 3(*a*).

FIG. 3(*b*) shows that locking pin 116, as described above. The locking pin magnet 120 is coupled to the locking pin 116 by shaft portion 302. The locking pin magnet 120, is formed of a first locking pin magnet 304 and a second locking pin magnet 306. The first locking pin magnet is configured to be magnetically attracted to the first gate magnet 122, and the second locking pin magnet is configured to the magnetically repelled from the second gate magnet 126.

FIG. 3(*c*) shows a variant of a locking pin 308, which comprises a locking pin magnet 310 coupled to the locking pin 308 by shaft portion 312, and a locking pin magnet 314. In this example, the locking pin magnet 310 is configured to be magnetically attracted to gate magnet 122. A second locking pin magnet is not provided, and as such the second gate magnet 126 is also not provided.

FIG. 3(*d*) shows a variant of a locking pin 316, which comprises a locking pin magnetic portion 318 coupled to the locking pin 316 by a shaft portion 320. The locking pin magnetic portion 318 is formed of a ferromagnetic material, such as steel. As such, the first gate magnet 122 is configured to magnetically attract the ferromagnetic locking pin magnetic portion 318.

As will be appreciated, equivalent variants of locking pin 114 to the variants of locking pin 116 shown in FIGS. 3(*b*), 3(*c*) and 3(*d*) are envisaged.

As the first gate 100 is traversed away from the alignment configuration, the locking pin magnets 118 and 120 move away from the first gate magnets 122 and 124, and so the locking pin, under gravity, moves back from the second position to the first position. In addition, the upper edge of the recessed channel having a cammed profile can apply a direct force to the locking pin magnets to assist the movement of the locking pins from the second position to the first position. As will be appreciated, this ensures that if the locking pins become stuck in the unlocked, second position, for any reason, the gate system fails safe because the locking pin magnets will engage with the upper edge of the recess and prevent the gates from being separated. By "fail safe", it is meant that in no situation is it possible for the gates to be in a configuration where the locking pins are in the unlocked position, and the lifting carriage can fall from the end of the rail.

Figure 4B:
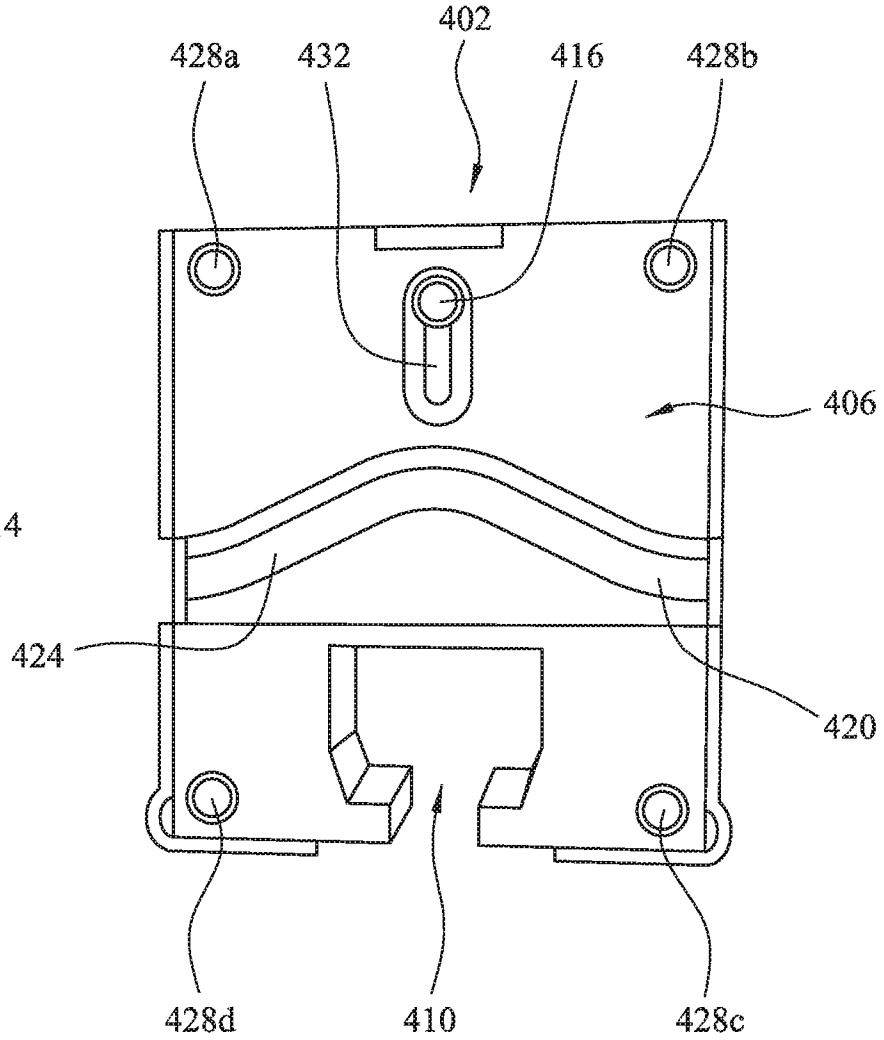
FIG. 4(*a*) shows an alternative embodiment of a locking gate system for an overhead lifting rail system.
Figure 4A:
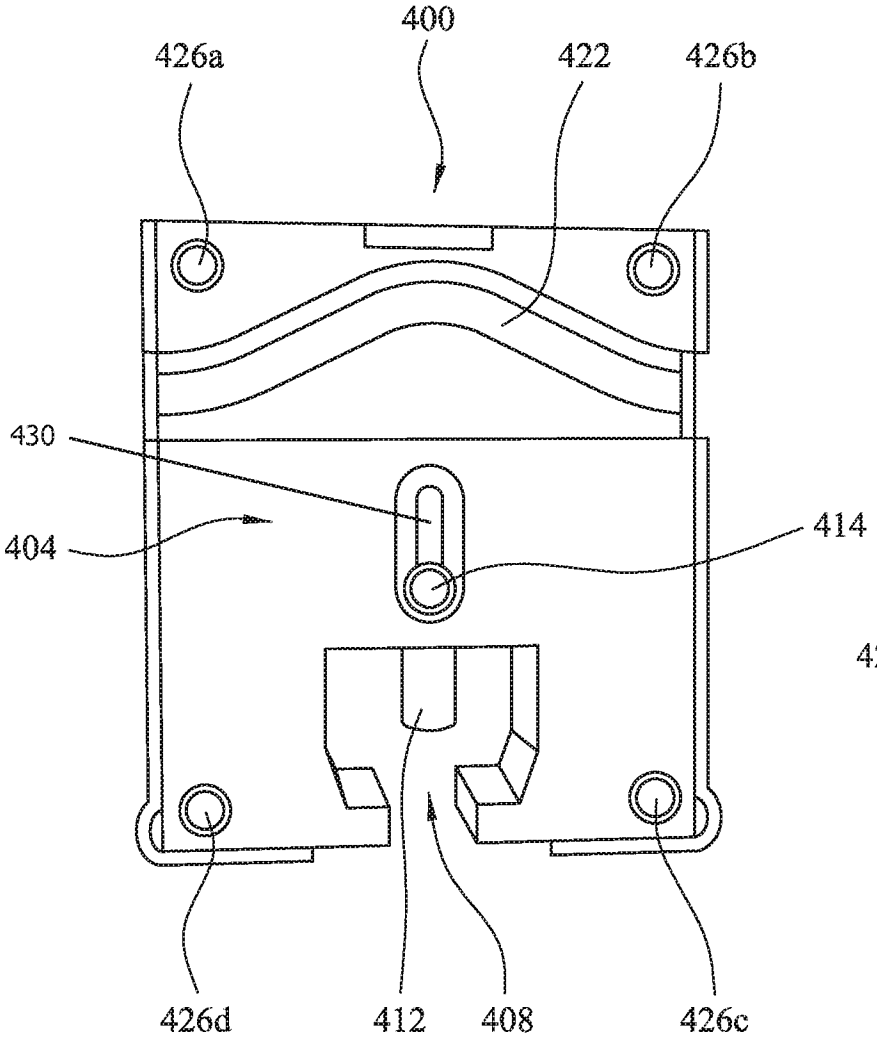

FIGS. 4(*a*) and 5(*b*) show an alternative example of a locking gate system. The example shown in FIGS. 4(*a*) and 4(*b*) comprises a first gate 400 and a second gate 402, and is of generally similar construction to the example described above with reference to FIGS. 1 to 3. In this example, the gate 400 is coupled to a traverse rail (not shown), and the gate 402 is coupled to a fixed rail (not shown). For ease of reference, the faces 404 and 406 of the gates which engage with each other are shown facing away from each other, but as will be appreciated, in use, the faces 404 and 406 face each other. The first gate 400 and the second gate 402 each comprise, inter alia, a rail portion 408, 410, a locking pin 412, a locking pin magnet 414, 416, a gate magnet 418, 420, and a recessed channel 422, 424. The first gate 400 and second gate 402 each further comprise alignment magnets 426*a*, 426*b*, 426*c*, 426*d*, 428*a*, 428*b*, 428*c*, 428*d* respectively provided at the corners of the engaging faces 404 and 406. The alignment magnets 426 are configured to be magnetically attracted to the alignment magnets 428. That is to say, the north pole of the magnets 426 faces outwards, and the south pole of the magnets 428 faces outwards (or vice versa).

The locking pin magnet 414, 416 is coupled perpendicularly to the respective locking pin by a shaft (not shown). The locking pin is vertically slidable within a bearing to enable the pin to slide from a first position, as shown in FIG. 4(*a*), to a second position, as shown in FIG. 4(*b*). As the locking pin slides from the first position to the second position, the locking pin magnet shaft slides within the slot 430, 432.

In the first position, the locking pin blocks the rail portion 408, 410 so that a lifting carriage is blocked from traversing the respective rail portion. In this way, when the rail portion 408 is not aligned with the rail portion 410 the locking pins prevent the lifting carriage from rolling off the end of the rail.

As can be seen, each recessed channel 422 and 424 has an upper edge with a cammed profile. The lower edge of each recessed channel is substantially planar, but is shown having tapered end portions.

The second gate 402 is mounted to a ceiling (not shown) by a mounting support in a similar manner to the example described above with reference to FIGS. 1 to 3. The first gate 400 is mounted to a traverse rail (not shown), which in turn is mounted to the ceiling by further guide rails which enable movement of the traverse rail perpendicularly to the longitudinal length of the rail.

In this example, the main body of each gate 400, 402 is formed of aluminium to reduce the total weight as compared to, for example, steel, and to reduce or eliminate the magnetic interference between the main body and the gate magnet and locking pin magnet. The locking pins and shaft portions for coupling the locking pin magnets to the locking pins are formed of steel. The magnets are formed of an alloy of Neodymium, Iron, and Boron, which are commonly known simply as Neodymium magnets. The bearings are formed of polyoxymethylene (POM).

Figure 5:
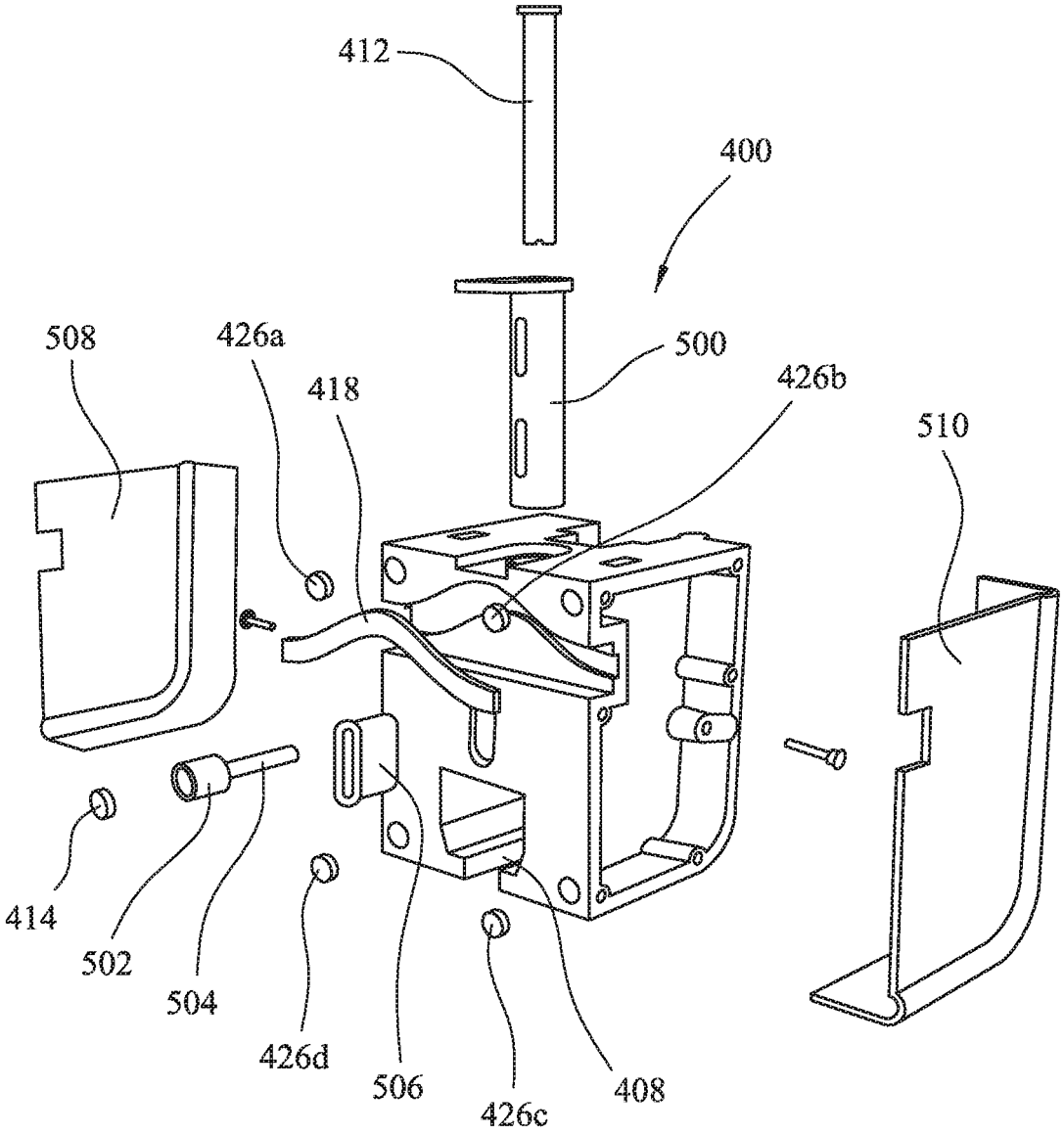
FIG. 5 shows an exploded view of a gate as shown in FIG. 4(*a*)

FIG. 5 shows an exploded view of first gate 400. The components of first gate 400 are shown in greater detail. As described above the locking pin 412 is housed in a bearing 500, which is inserted into the main body of the first gate 400. The locking pin magnet 414 is coupled to the locking pin 412 by the shaft portion 502. The shaft portion 502 is screwed into the locking pin using threaded portion 504. The slot 430 is formed using an insert 506, formed of the same material as the bearing 500. Also shown are cover plates 508 and 510.

In particular, FIG. 5 shows that the gate magnet is provided with a cammed profile which matches the cammed profile of the upper edge of the recessed channel.

Upon the first gate 400 being traversed into alignment with the second gate 402, the gate magnet 418 of the first gate 400 attracts the locking pin magnet 416 of the second gate 402, and the gate magnet 420 of the second gate 402 attracts locking pin magnet 414 of the first gate 400. The locking pin magnets are drawn along the cammed profile of the gate magnets, and thereby move the locking pins from a first, locked, position to a second, unlocked position upon the first gate 400 and the second gate 402 being aligned.

In this aligned configuration, the alignment magnets 426 and 428 maintain the gates together until a user, such a healthcare professional, moves the traverse rail.

With the gates aligned, and the locking pins in the second position, a lifting carriage is free to traverse the rails from the fixed rail to the traverse rail or vice versa. This is because a substantial portion of a lifting carriage of this type runs within the rails, being supported by the support surface of the rails.

As the first gate 400 is traversed away from the alignment configuration, the locking pin magnets continue to follow the cammed profile of the gate magnets, and thereby move the locking pins back from the second position to the first position. In addition, the upper edge of the recessed channel, also having a cammed profile, if needed can apply a direct force to the locking pin magnets to assist the movement of the locking pins from the second position to the first position. As will be appreciated, this ensures that if the locking pins become stuck in the unlocked, second position, for any reason, the gate system fails safe because the locking pin magnets will engage with the upper edge of the recess and prevent the gates from being separated. By "fail safe", it is meant that in no situation is it possible for the gates to be in a configuration where the locking pins are in the unlocked position, and the lifting carriage can fall from the end of the rail.

Figure 6:
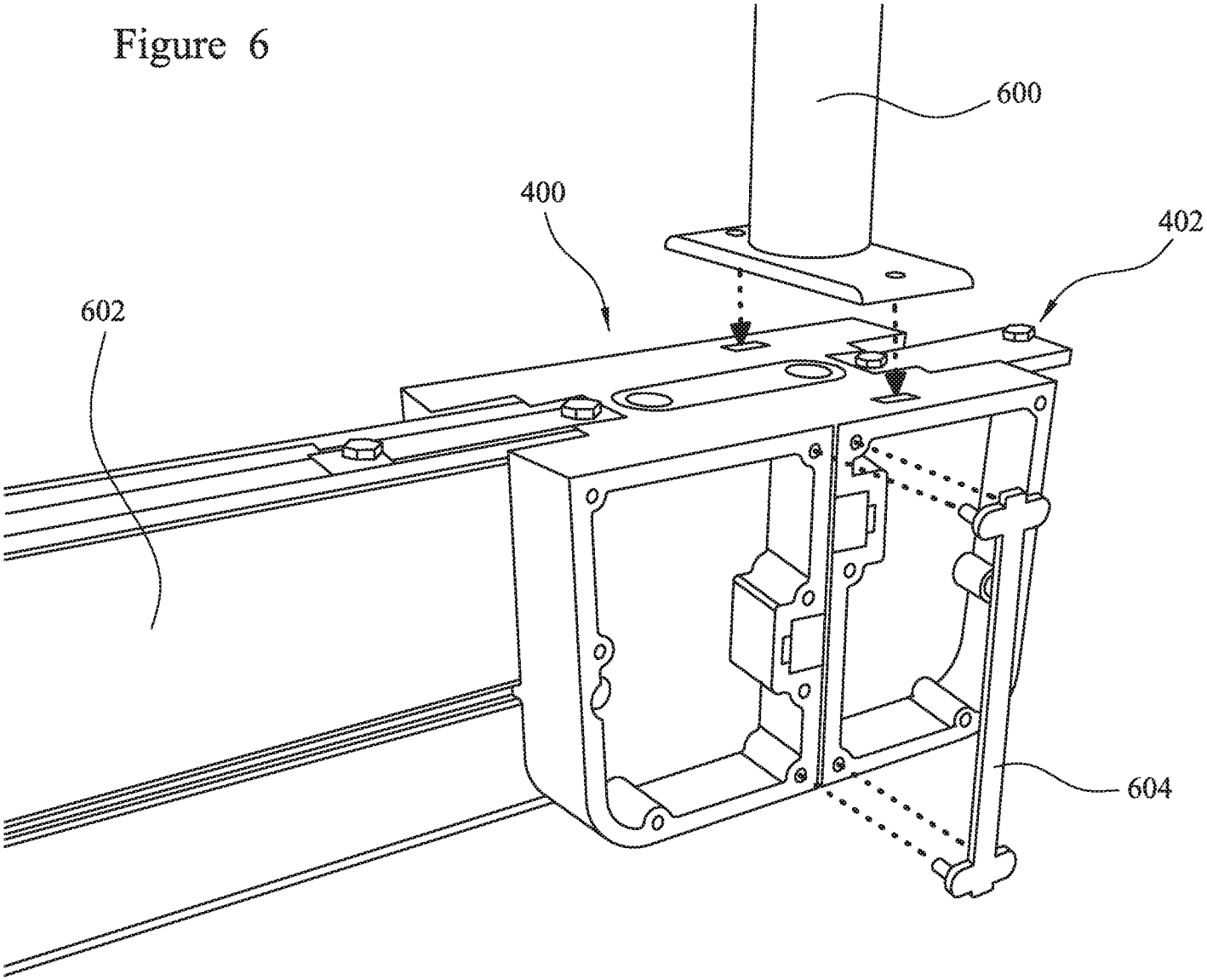
FIG. 6 shows an alternative view of the gate system shown in FIGS. 4(*a*) and 4(*b*)

Referring now to FIG. 6, the method of installation of a gate system is shown. Although the example shown in FIG. 6 relates to FIGS. 4 and 5, the installation process is also applicable to the example shown in FIGS. 1 to 3. As can be seen, the process of installation requires the second gate 402 to be mounted to a ceiling using support 600. The first gate 400, attached to the traverse rail 602 is then adjusted into position using tool 604. Tool 604 has a plurality of pins which engage with corresponding holes in the gates 400 and 402 to ensure the proper separation between the gates. The separation may be between about 3 mm and 5 mm.

As will be appreciated, the components of the second gate 402 are identical to those used in the first gate 400, except for the distance of the recessed channel from the rail portion to avoid interference between the locking pin magnets.

In addition, it will also be appreciated that the gate system described above with reference to FIGS. 1 to 3 is similar to the gate system described with reference to FIGS. 4 to 6, and both systems are constructed in similar manners, and from similar materials.

Figures 7A, 7B:
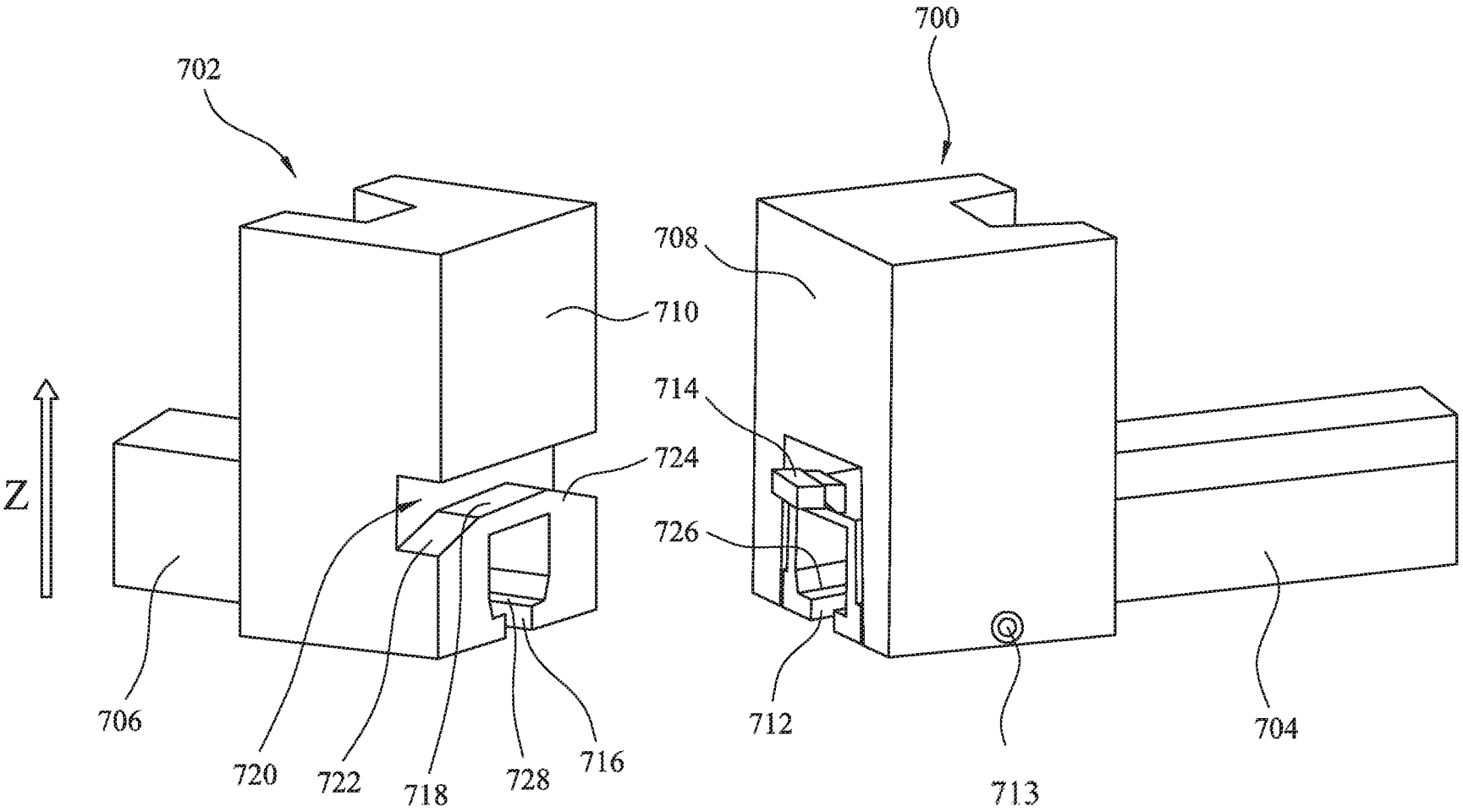
FIG. 7(*a*) shows a bridging gate system for an overhead lifting rail system.

FIGS. 7(*a*) and 7(*b*) show a further gate system for an overhead lifting rail system. The gate system comprises a first gate 700, and a second gate 702. The first gate 700 is attached to a fixed rail 704, and the second gate is attached to a traverse rail 706. The gate system shown in FIG. 7 is a bridging gate system which enable the smooth running of a lifting carriage between the gates even when there is a vertical misalignment between the gates. The present example is capable of operating with a vertical misalignment of up to about 3 mm.

For ease of reference, the faces 708 and 710 of the gates which engage with each other are shown facing away from each other, but as will be appreciated, in use, the faces 708 and 710 face each other. The first gate 700 comprises, inter alia, a bridging element 712 pivotally coupled at a proximal end to the main body of the first gate by pivots 713. The distal end of the bridging element 712 comprises an L-shaped cantilevered portion 714, which is displaced upwards from the top of the bridging element 712 to prevent interference with the lifting carriage.

The second gate 702 comprises, inter alia, a rail portion 716, and a bridging element support 718 configured to support the cantilevered portion 714 of the bridging element 712 when the gates are engaged.

The bridging element support 718 is formed by a recessed channel 720 in the face 710 of the second gate. As can be seen, the recessed channel has tapered end portions 722 and 724.

In use, as the second, traverse rail, gate 702 engages with the first, fixed rail, gate 700, the cantilevered portion 714 of the bridging element 712 engages with the lower edge of the recessed channel, i.e. the bridging element support 718. The relative dimensions of the bridging element support 718 and the cantilevered portion 714 are such that the lifting carriage support portion 726 of the bridging element 712 is substantially aligned with the lifting carriage support portion 728 of the rail portion 716. As will now be appreciated, any vertical misalignment, i.e. in the Z direction, will cause the bridging element 712 to pivot about the pivots 713 and maintain the alignment of the various lifting carriage support portions of the rails. Therefore, the gate system has the advantage of reducing the force required to push the lifting carriage over any steps in the rail caused by misalignment, and also reduces noise, and wear on the system. Such misalignment generally occurs when the traverse rail is under load due to a patient being lifted by a lifting carriage being supported by the traverse rail.

The tapered end portions 722 and 724 enable the engagement of the first gate and second gate even when the traverse rail is already under load. This is because the ends of the recessed channel are about 5 mm lower than the middle of the recessed channel forming the bridging element support 718.

The example shown in FIG. 7 may further comprise alignment magnets as described above with reference to FIGS. 1 to 6.

Figure 8:
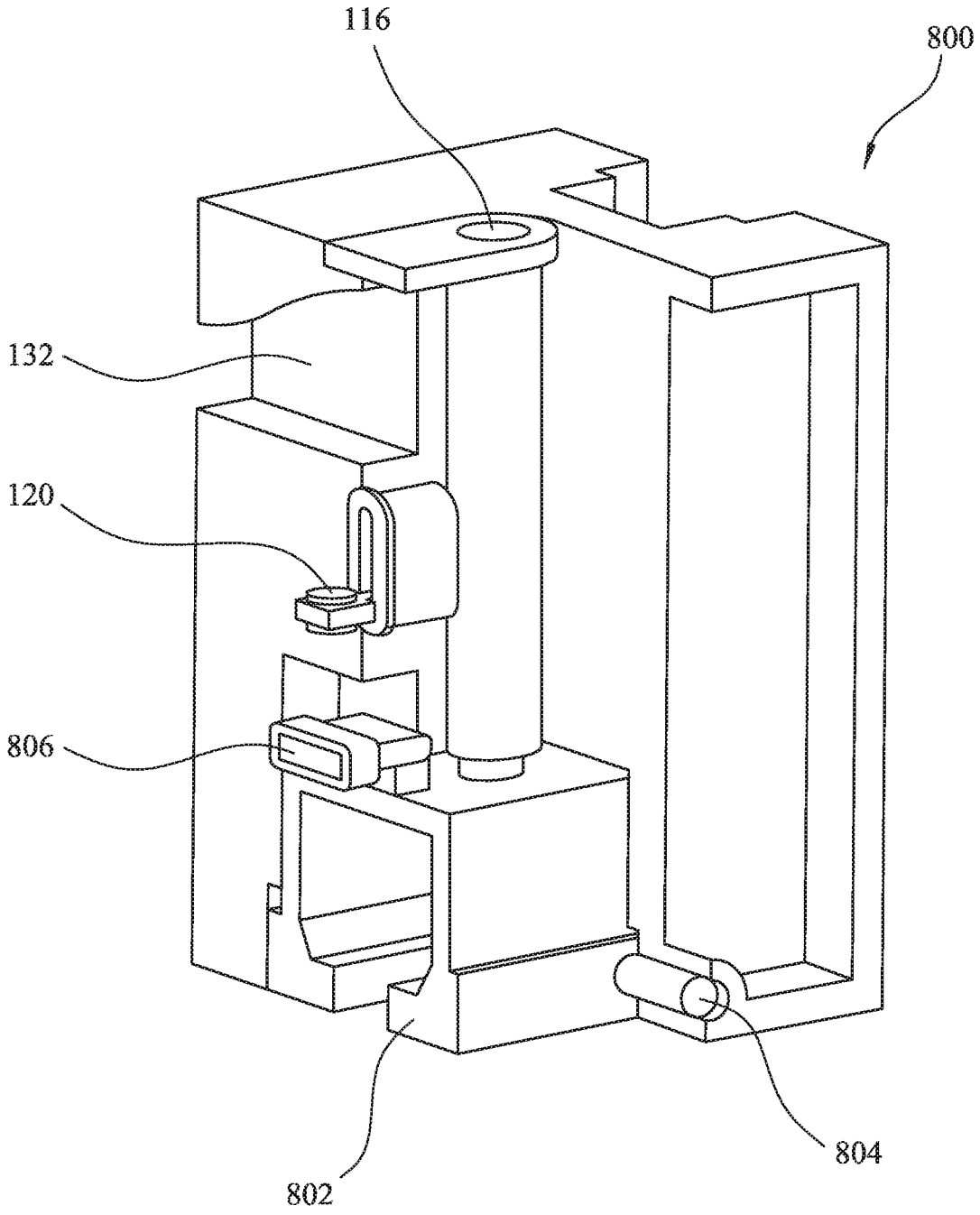
FIG. 8 shows a cut-away view of an alternative embodiment of a bridging gate.

FIG. 8 shows an alternative example of a gate for use in a gate system for an overhead lifting rail system. The example shown in FIG. 8, in effect, combines the locking gate features described above with reference to FIGS. 1 to 3, and the bridging gate features described above with reference to FIG. 7. As can be seen in this cut-away of gate 800, the gate comprises a bridging element 802 similar to bridging element 712, pivotally coupled to the main body of the gate by pivots 804. Again, similarly to the example shown in FIG. 7, a cantilevered support 806 is provided. The bridging element 802 further comprises a through hole for enabling the locking pin 116 to pass therethrough. The locking pin comprises the locking pin magnet 120 coupled to the locking pin by a shaft portion, the shaft portion being slidable in a slot 144.

Figure 9B:
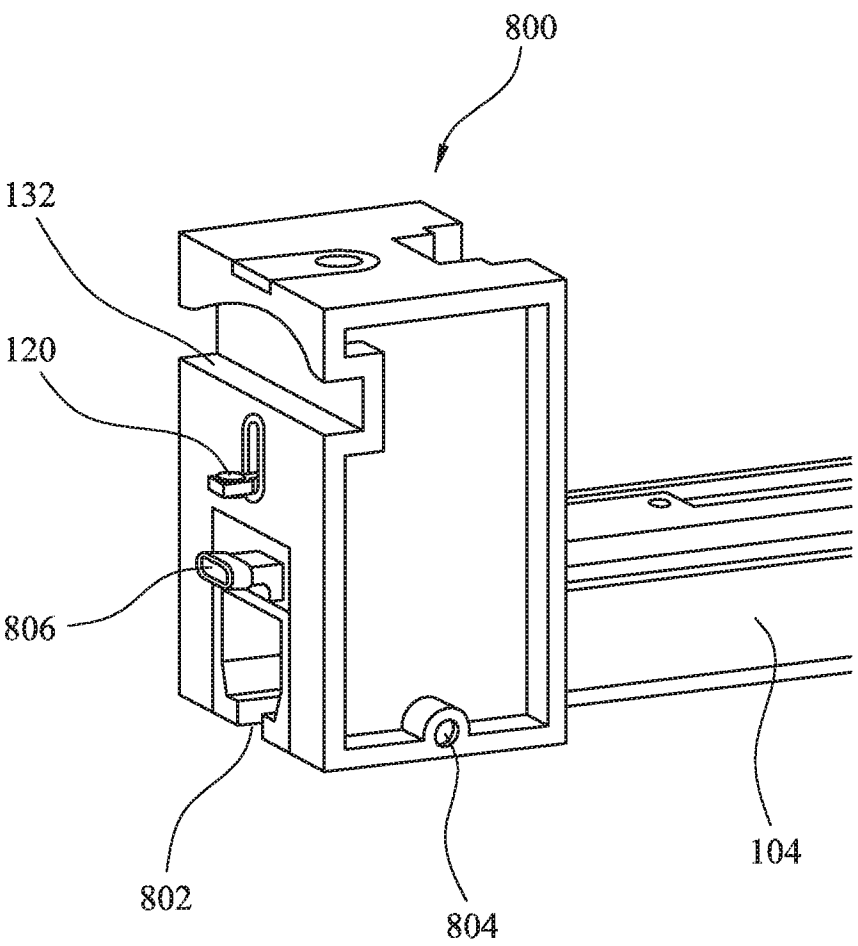
FIG. 9(*a*) shows an alternative embodiment of a bridging gate for a bridging gate system comprising the bridging gate shown in FIG. 8.
Figure 9A:
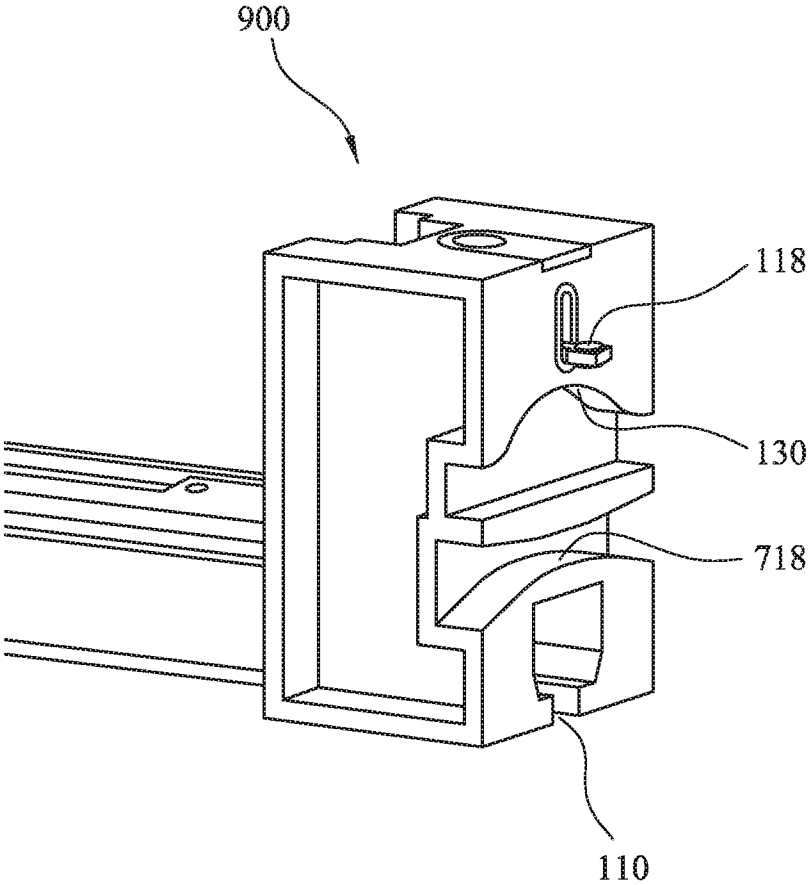
Figure 10:
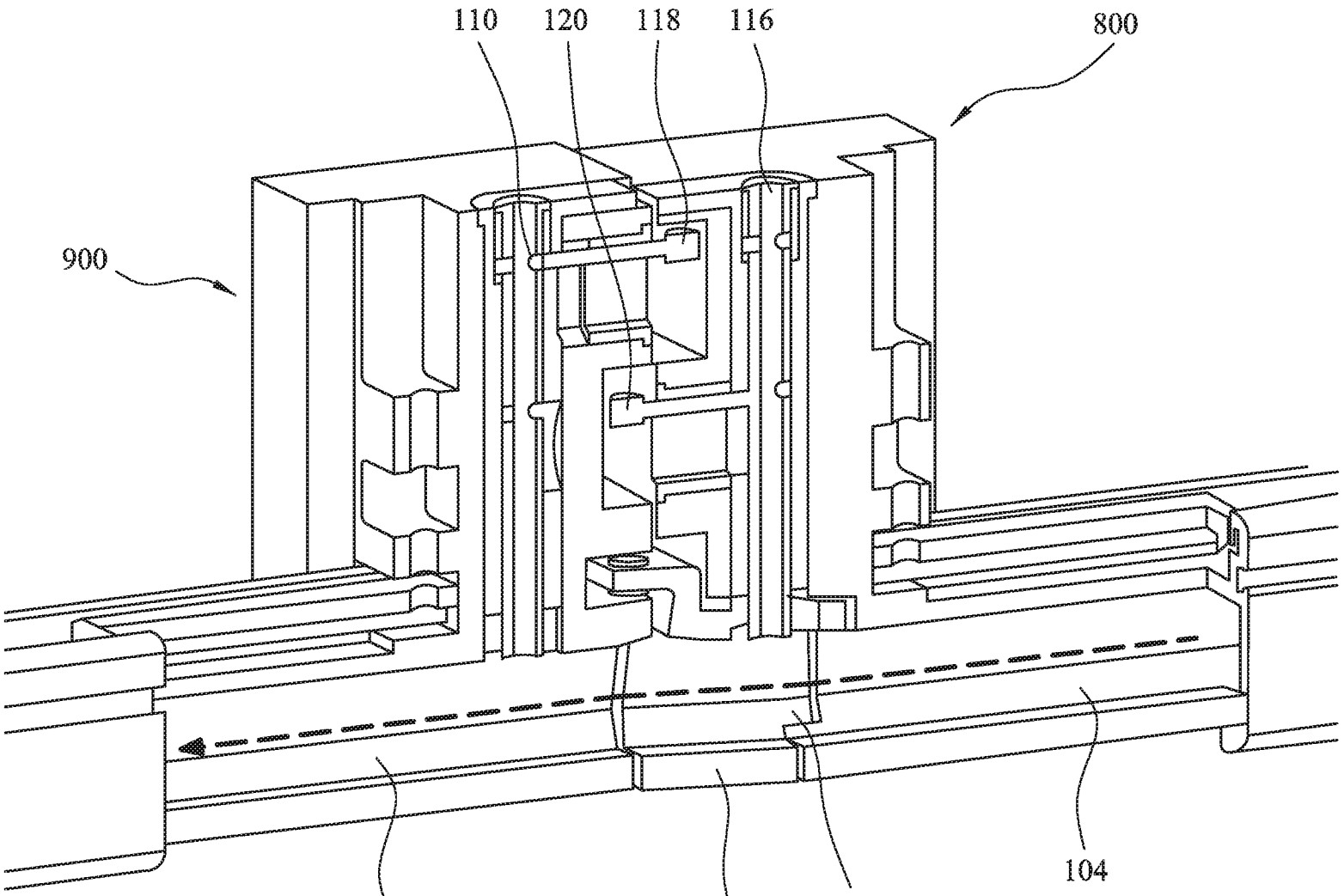
FIG. 10 shows a cut-away view of the gate system of the gate system shown in FIG. 9.

Referring now to FIGS. 9(*a*) and 9(*b*), it can be further seen that the gate system comprises the features of the locking gate system described above with reference to FIGS. 1 to 3 in combination with the bridging gate system of FIG. 7. However, it is envisaged that, in the alternative, the locking gate system of FIGS. 4 to 6 could be combined with the gate system of FIG. 7. In use, the gate system, shown in FIGS. 9(*a*) and 9(*b*), and in the cut-away shown in FIG. 10, operates in a manner as described above with reference to FIGS. 1 to 3, and FIG. 7, and is referred to here.

Figure 11:
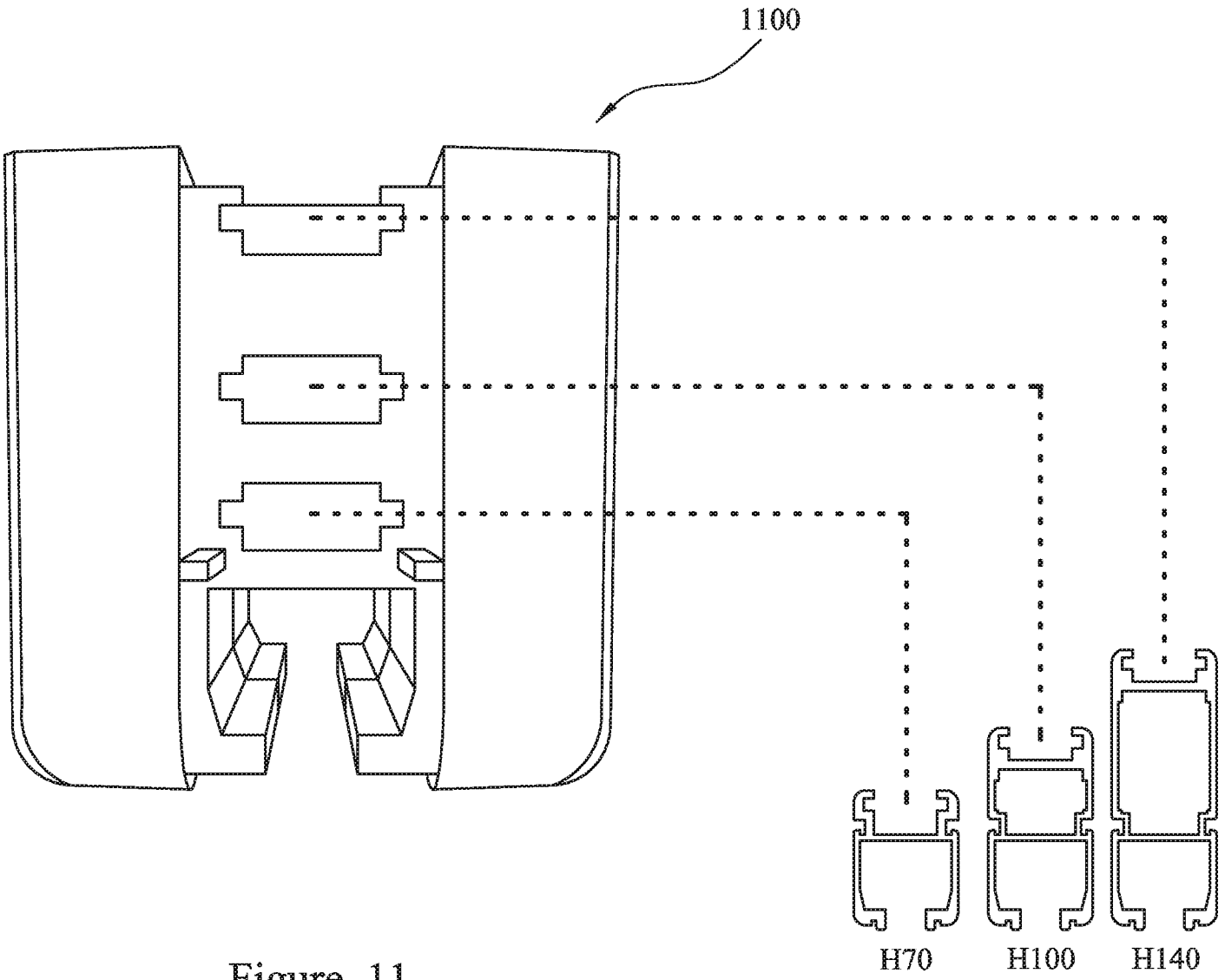
FIG. 11 shows an end view of a gate.

In all of the above described examples, the rear face of the gates, that is to say the face opposite the engaging face, comprises recessed portion for receiving and mounting the rail portions. FIG. 11 shows a rear face 1100 of a gate. As can be seen, each rear face is configured such that any one of three standard rail sizes, H70, H100 or H140 can be mounted to the gate. In each case, the rail is mounted using a self-tapping screw, screwed through the main body of the gate and into the side edge of the rail. The rail sizes relate to the rail heights, being 70 mm, 100 mm, or 140 mm.

Although the first gate and second gate are designed to work together, either gate may be supplied separately, for example where a healthcare facility may have multiple fixed rails for each traverse rail.

The specific embodiments and examples described above illustrate but do not limit the present disclosure. It is to be understood that other embodiments may be made and the specific embodiments and examples described herein are not exhaustive.

The invention claimed is:

1. A gate for an overhead lifting rail, comprising:

a rail portion for suspending a lifting carriage;

a locking pin movable between a first position and a second position, wherein in the first position the lifting carriage is blocked from traversing the rail portion, and in the second position the lifting carriage is able to traverse the rail portion;

a locking pin magnetic portion coupled to the locking pin; and a gate magnetic portion fixed relative to the rail portion;

wherein, at least one of the locking pin magnetic portion and the gate magnetic portion is a permanent magnet, upon the gate engaging with a corresponding second gate also comprising a rail portion, a locking pin, a locking pin magnet portion and a gate magnetic portion, the locking pin magnetic portion of the gate engages with the gate magnetic portion of the corresponding second gate such that, upon the rail portion of the gate being substantially aligned with the rail portion of the corresponding second gate, the locking pin is moved from the first position to the second position.

2. A gate system for an overhead lifting rail system, comprising:

a first gate, and a second gate, each gate comprising:

a rail portion for suspending a lifting carriage;

a locking pin movable between a first position and a second position, wherein in the first position the lifting carriage is blocked from traversing the rail portion, and in the second position the lifting carriage is able to traverse the rail portion;

a locking pin magnetic portion coupled to the locking pin; and a gate magnetic portion fixed relative to the rail portion;

wherein, at least one of the locking pin magnetic portion and the gate magnetic portion is a permanent magnet, upon the first gate engaging with the second gate, the locking pin magnetic portion of the first gate engages with the gate magnetic portion of the second gate, and the locking pin of the second gate engages with the gate magnetic portion of the first gate such that, upon the rail portions being substantially aligned, each locking pin is moved from the first position to the second position.

3. The gate system according to claim 2, wherein each gate magnetic portion is configured to magnetically attract the respective locking pin magnetic portion.

4. The gate system according to claim 2, wherein each locking pin magnetic portion protrudes from the respective gate, and each gate magnetic portion is provided in a recessed channel in the respective gate, the recessed channel extending from a first side to a second side of the gate.

5. The gate system according to claim 4, wherein an edge of each recessed channel comprises a cam profile configured to engage the respective locking pin magnetic portion and move the locking pin from the second position to the first position upon the first gate and the second gate being disengaged.

6. The gate system according to claim 5, wherein the cam profile is substantially symmetrical about a centre line of the gate.

7. The gate system according to claim 5, wherein each gate magnetic portion has a shape which conforms to the cam profile.

8. The gate system according to claim 2, wherein each gate magnetic portion comprises a first gate magnet, and a second gate magnet, the first gate magnet being configured to magnetically attract the respective locking pin magnetic portion, and the second gate magnet being configured to magnetically repel the locking pin magnetic portion towards the first gate magnet.

9. The gate system according to claim 8, wherein the locking pin magnetic portion comprises a first locking pin magnet configured to magnetically attract the respective first gate magnet, and a second locking pin magnet configured to magnetically repel the respective second gate magnet.

10. The gate system according to claim 9, wherein:

each locking pin magnetic portion protrudes from the respective gate, and each gate magnetic portion is provided in a recessed channel in the respective gate, the recessed channel extending from a first side to a second side of the gate; and the first gate magnet is provided in a top edge of the recessed channel, and the second gate magnet is provided in a bottom edge of the recessed channel.

11. The gate system according to claim 2, wherein the gate magnetic portion is a permanent magnet, and the locking pin magnetic portion is a permanent magnet.

12. The gate system according to claim 2, wherein the gate magnetic portion is a permanent magnet and the locking pin magnetic portion is formed of a ferromagnetic material.

13. The gate system according to claim 2, each locking pin being slidably movable from the first position to the second position, wherein in the first position, a distal end of the locking pin protrudes through a hole in the rail portion to block the lifting carriage from traversing the rail portion, and in the second position, the distal end of the locking pin does not protrude through the hole in the rail portion.

14. The gate system according to claim 2, wherein the first gate further comprises at least one alignment magnet, and the second gate comprises at least one corresponding alignment magnet, the alignment magnets being configured to magnetically attract each other.

15. A gate system for an overhead lifting rail system, comprising:

a first gate comprising:

a rail portion for supporting a lifting carriage; and a bridging element pivotally coupled adjacent a proximal end to the rail portion; and a second gate comprising:

a rail portion for suspending a lifting carriage; and a bridging element support portion;

wherein:

upon the first gate engaging with the second gate, a distal end of the bridging element of the first gate engages with the bridging element support portion of the second gate to form a bridge between the first gate and the second gate; and the distal end of the bridging element and the bridging element support portion are configured such that ends of the bridging element are substantially aligned with the respective ends of the rail portions of the first and second gates, wherein the first gate and the second gate each further comprises:

a locking pin movable between a first position and a second position, wherein in the first position the lifting carriage is blocked from traversing the rail portion, and in the second position the lifting carriage is able to traverse the rail portion;

a locking pin magnet coupled to the locking pin; and a gate magnet fixed relative to the rail portion; and upon the first gate engaging with the second gate the locking pin magnet of the first gate engages with the gate magnet of the second gate, and vice versa, such that, upon the rail portion of the first gate being substantially aligned with the rail portion of the second gate, each locking pin is moved from the first position to the second position.

16. The gate system according to claim 15, wherein the bridging element is pivotally coupled at a position substantially aligned with a lifting carriage support surface of the rail portion.

17. The gate system according to claim 15, wherein each end of the bridging element support portion comprises a tapered portion.

18. The gate system according to claim 15, wherein the bridging element support portion is formed of an edge of a recessed channel extending from a first side to a second side of the first gate.

19. The gate system according to claim 15, wherein the distal end of the bridging element configured to engage with the bridging element support portion comprises a cantilever vertically offset from the bridging element.

* * * * *